United States Patent [19]

Weed

[11] Patent Number: 5,074,233

[45] Date of Patent: Dec. 24, 1991

[54] COLLAPSIBLE ONE-MAN PONTOON FISHING RAFT

[76] Inventor: Alvern C. Weed, 412 Boston Ct., Davenport, Iowa 52806

[21] Appl. No.: 621,760

[22] Filed: Dec. 4, 1990

[51] Int. Cl.[5] ..... B63B 7/04

[52] U.S. Cl. ..... 114/61; 24/442; 114/352; 273/DIG. 30

[58] Field of Search ..... 441/35, 44–47, 441/50, 75, 129, 130; 24/442–448; 114/56, 61, 85, 264, 266, 267, 343, 352, 354, 361, 363, 77 R; 446/901; 428/100; 273/DIG. 30

[56] References Cited

U.S. PATENT DOCUMENTS

| | | | |
|---|---|---|---|
| 3,883,909 | 5/1975 | Fisher | 114/61 |
| 4,285,082 | 8/1981 | Cox | 441/74 |
| 4,303,033 | 12/1981 | King | 114/352 |
| 4,531,733 | 7/1985 | Hall | 24/444 |
| 4,645,466 | 2/1987 | Elvis | 24/445 |
| 4,823,717 | 4/1989 | Roberson | 114/61 |
| 4,856,446 | 8/1989 | Herald | 114/61 |
| 4,892,052 | 1/1990 | Zook | 114/61 |
| 4,919,632 | 4/1990 | Smith | 114/61 |

*Primary Examiner*—Joseph F. Peters, Jr.
*Assistant Examiner*—Clifford T. Bartz

[57] ABSTRACT

A collapsible fishing raft comprising pontoons and a seat which, when secured to the pontoons, maintains the spaced relationship between the pontoons.

1 Claim, 3 Drawing Sheets

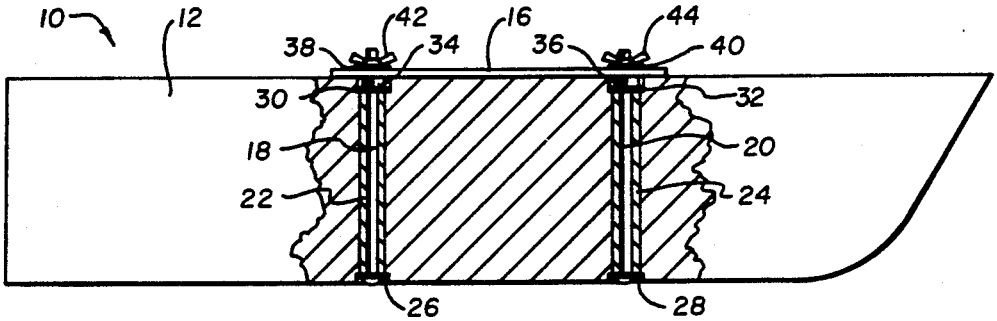
Fig 1
Fig 2
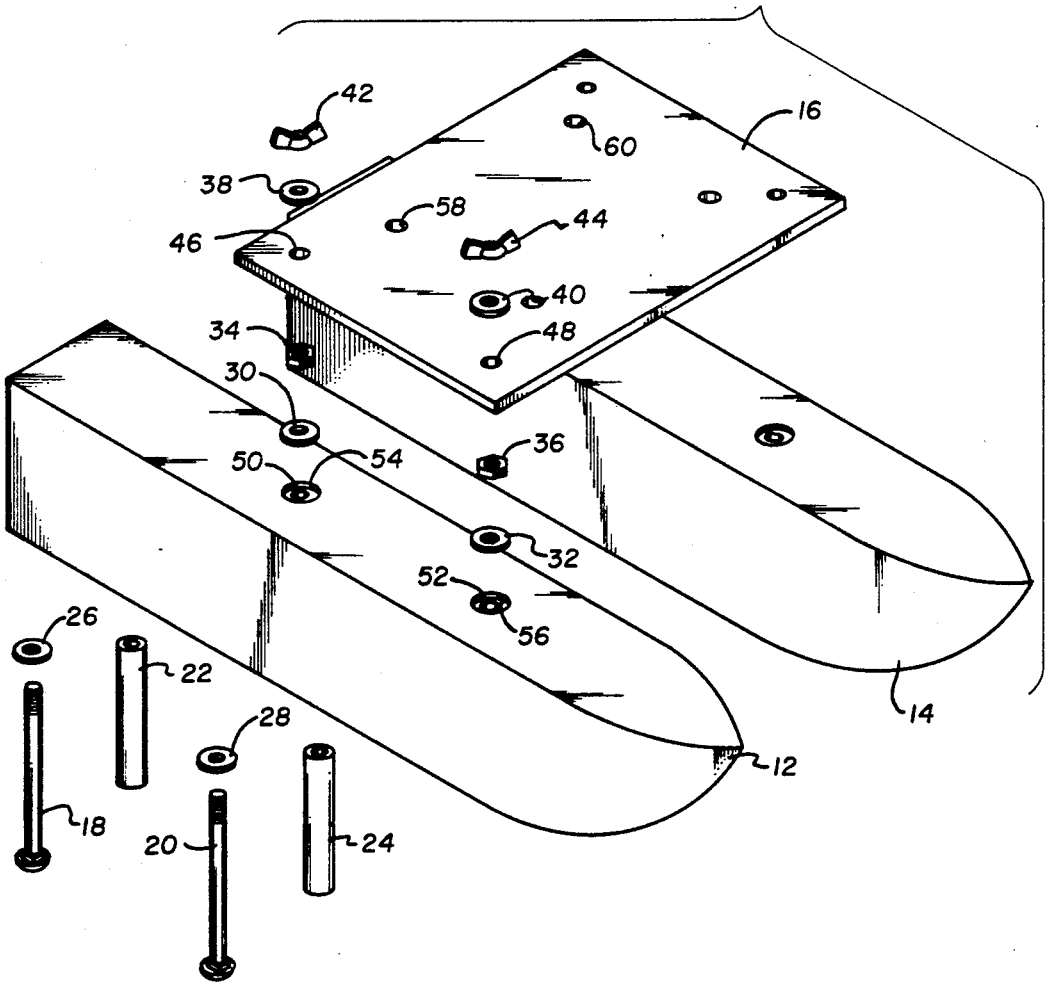

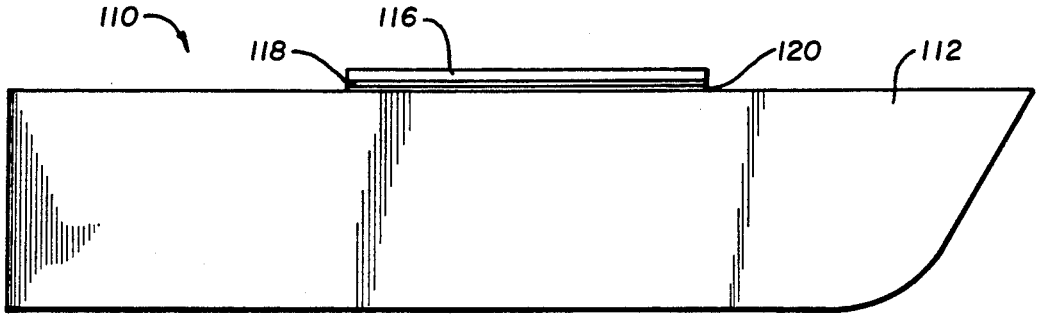
Fig 3
Fig 4
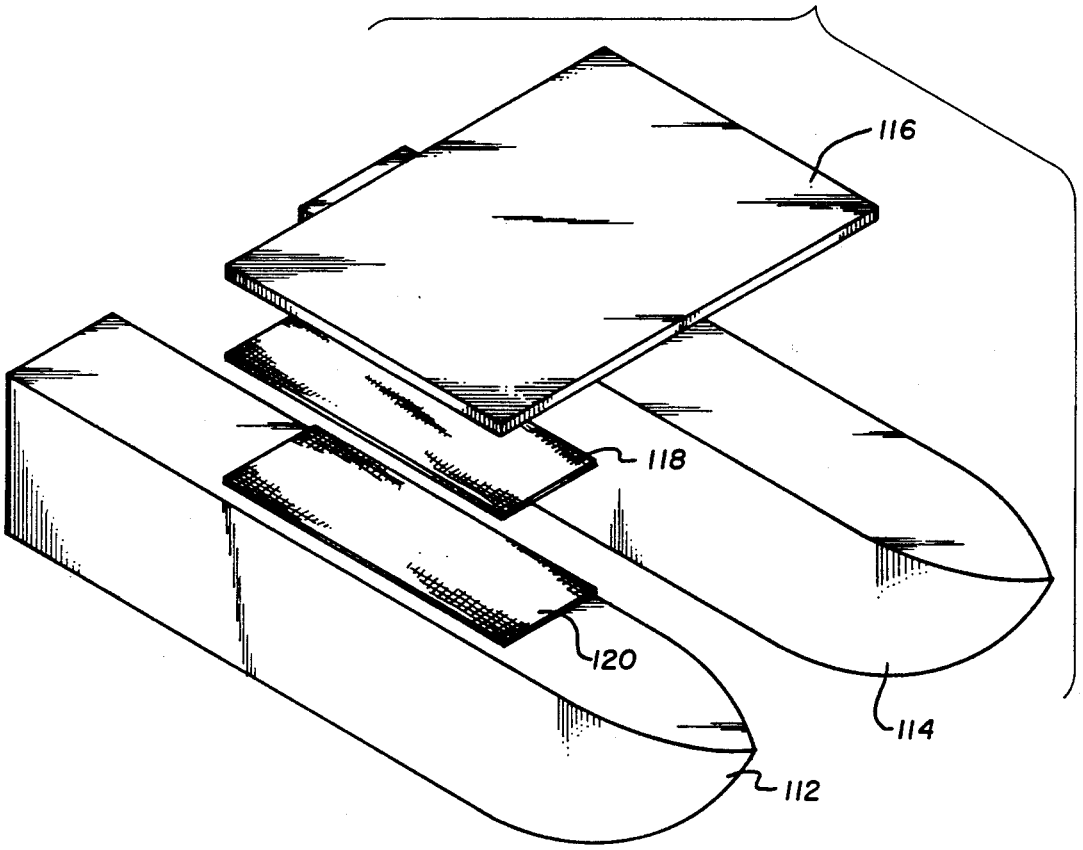

COLLAPSIBLE ONE-MAN PONTOON FISHING RAFT

BACKGROUND OF THE INVENTION

The pontoon fishing raft in Smith et al, U.S. Pat. No. 4,919,632 contemplated many loose components and assembly was overly complicated and time consuming.

SUMMARY OF PRESENT INVENTION

In accordance with the present invention a seat is secured to pontoons by at least two carriage bolts or similar fastener which pass through each pontoon with the threaded end exposed above the top surface of the pontoons. In assembly, the threaded ends pass through holes in each end of the seat and threaded nuts can be screwed down on each bolt to attach the seat securely.

BRIEF DESCRIPTION OF THE DRAWINGS

FIG. 1 is a side view of the bolt fastener version
FIG. 2 is exploded view of the bolt fastener version
FIG. 3 is a side view of the velcro fastener version
FIG. 4 is exploded view of the velcro fastener version

DETAILED DESCRIPTION OF ILLUSTRATIVE EMBODIMENT

Figure 5:
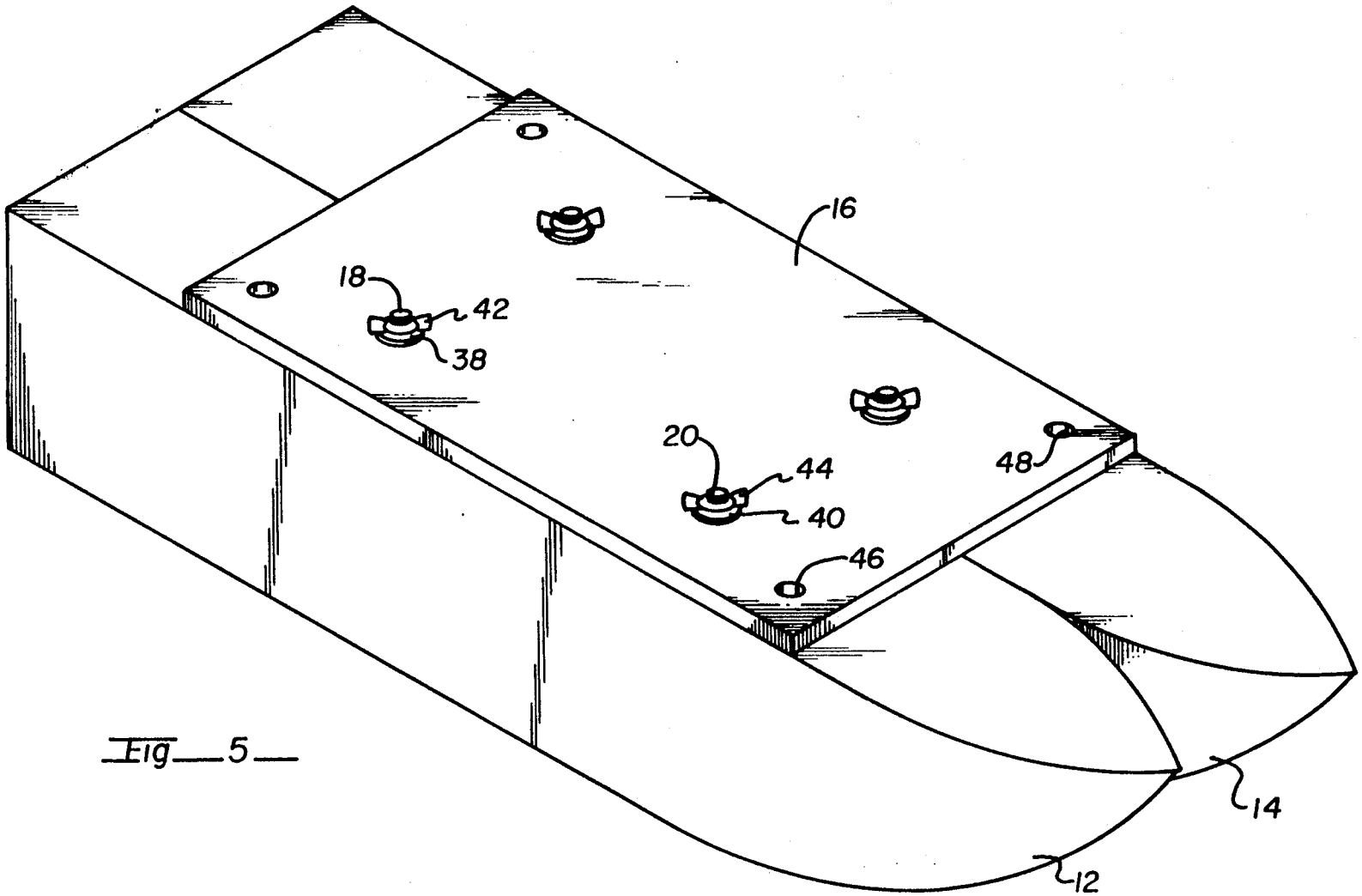
FIG. 5 is the collapsed raft reassembled for transport

Reference is now made to FIG. 1 wherein is shown the side view of raft 10 with pontoon 12 and seat 16 secured together by threaded bolts 18 and 20 which pass through the pontoon 12 through the seat 16, which are firmly held together by a wing nuts 42 and 44 bearing against washers 38 and 40.

FIG. 2 shows the exploded view with sleeves 22 and 24, made from polyvinylchloride or other material, inserted into the holes 50 and 52 in the pontoons 12 and 14. The bolts 18 and 20 pass through the sleeves 20 and 24 and are permanently fastened to the pontoons 12 and 14 by nuts 42 and 44. Washers 26 and 30 and 28 and 32 at each end of the sleeves 20 and 24 prevent the bolts 18 and 20 or nuts 34 and 36 from penetrating into the pontoon material. When assembled the threaded ends of the bolts 18 and 20 extend beyond the top surface of the pontoons 12 and 14 such that they may pass through holes 46 and 48 on the seat 16. Wing nuts 42 and 44 or similar fasteners may be used to secure the seat 16 firmly to the pontoons 12 and 14.

As shown in FIG. 3 and FIG. 4 the pontoons 112 and 114 and seat 116 may be secured together by Velcro TM strips 118 and 120 which are permanently bonded to those components.

FIG. 5 shows the collapsed raft with pontoons 12 and 14 positioned side by side and touching. When the seat 16 is rotated ninety degrees holes 58 and 60 as depicted in FIG. 2 will mate with bolts 18 and 20. Wing nuts 42 and 44 or similar fasteners may be used to secure the seat 16 firmly to the pontoons 12 and 14 for transportation in the collapsed configuration.

I claim:

1. A collapsible one-man pontoon fishing raft comprising: at least two, spaced, floatational pontoons, threaded bolts passing vertically through the pontoons, said bolts being of such dimension that when they are secured to the said pontoons the threaded ends protrude above the top surface of the pontoons, means for maintaining the spaced relation between pontoons comprising a seat having at least four holes, at least two near each end which, when said seat is placed on the top surface of said pontoons, will mate with the threaded bolts protruding from the top surface of the said pontoons, and at least four additional holes which, when the seat is removed from the raft and rotated approximately ninety (90) degrees and when the pontoons are positioned side by side in close proximity, will likewise mate with the threaded bolts protruding from the top surface of the said pontoons, nuts which screw down the bolts and against the seat securing it firmly to the pontoons.

* * * * *